US007642720B2

(12) United States Patent
Eden et al.

(10) Patent No.: US 7,642,720 B2
(45) Date of Patent: Jan. 5, 2010

(54) ADDRESSABLE MICROPLASMA DEVICES AND ARRAYS WITH BURIED ELECTRODES IN CERAMIC

(75) Inventors: J. Gary Eden, Mahomet, IL (US); Sung-Jin Park, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 614 days.

(21) Appl. No.: 11/337,969

(22) Filed: Jan. 23, 2006

(65) Prior Publication Data

US 2009/0295288 A1 Dec. 3, 2009

(51) Int. Cl.
*H01J 17/04* (2006.01)
*H01J 17/49* (2006.01)

(52) U.S. Cl. ..... 313/631; 313/582

(58) Field of Classification Search ..... None
See application file for complete search history.

(56) References Cited

U.S. PATENT DOCUMENTS

| | | | | |
|---|---|---|---|---|
| 4,329,626 | A | 5/1982 | Hillenbrand et al. | |
| 6,016,027 | A | 1/2000 | De Temple et al. | |
| 6,139,384 | A | 10/2000 | De Temple et al. | |
| 6,194,833 | B1 | 2/2001 | De Temple | |
| 6,309,610 | B1 | 10/2001 | Nejezchleb | |
| 6,541,915 | B2 | 4/2003 | Eden | |
| 6,563,257 | B2 | 5/2003 | Vojak et al. | |
| 6,580,217 | B2 * | 6/2003 | Kim et al. | 313/582 |
| 6,612,889 | B1 * | 9/2003 | Green et al. | 445/24 |
| 6,695,664 | B2 | 2/2004 | Eden et al. | |
| 6,815,891 | B2 | 11/2004 | Eden et al. | |
| 6,828,730 | B2 | 12/2004 | Eden et al. | |
| 6,867,548 | B2 | 3/2005 | Eden et al. | |
| 2002/0113553 | A1 | 8/2002 | Vojak | |
| 2003/0036461 | A1 | 2/2003 | Yang | |
| 2003/0080664 | A1 | 5/2003 | Eden et al. | |

(Continued)

FOREIGN PATENT DOCUMENTS

| | | | |
|---|---|---|---|
| JP | 08106852 | A | 4/1996 |

OTHER PUBLICATIONS

K Tachibana et al, Characteristics of Ne—Xe microplasma in unit discharge cell of plasma display panel equipped with counter sustain electrodes and auxiliary electrodes, 2005 J. Phys. D: Appl. Phys. 38 1739, doi: 10.1088/0022-3727/38/11/015.*

(Continued)

*Primary Examiner*—Toan Ton
*Assistant Examiner*—Britt Hanley
(74) *Attorney, Agent, or Firm*—Greer, Burns & Crain, Ltd.

(57) ABSTRACT

An array of microcavity plasma devices is formed in a ceramic substrate that provides structure for and isolation of an array of microcavities that are defined in the ceramic substrate. The ceramic substrate isolates the microcavities from electrodes disposed within the ceramic substrate. The electrodes are disposed to ignite a discharge in microcavities in the array of microcavities upon application of a time-varying potential between the electrodes. Embodiments of the invention include electrode and microcavity arrangements that permit addressing of individual microcavities or groups of microcavities. The contour of the microcavity wall allows for the electric field within the microcavity to be shaped.

18 Claims, 9 Drawing Sheets

U.S. PATENT DOCUMENTS

| | | | |
|---|---|---|---|
| 2003/0080688 | A1 | 5/2003 | Eden et al. |
| 2003/0132693 | A1 | 7/2003 | Eden et al. |
| 2003/0228416 | A1 | 12/2003 | Iwamaru |
| 2003/0230983 | A1 | 12/2003 | Vonallmen |
| 2004/0100194 | A1 | 5/2004 | Eden et al. |
| 2004/0160162 | A1 | 8/2004 | Eden et al. |
| 2005/0148270 | A1 | 7/2005 | Eden et al. |
| 2005/0269953 | A1 | 12/2005 | Eden et al. |
| 2006/0012277 | A1 | 1/2006 | Park et al. |
| 2006/0038490 | A1 | 2/2006 | Eden et al. |
| 2006/0071598 | A1 | 4/2006 | Eden et al. |
| 2006/0082319 | A1 | 4/2006 | Eden et al. |
| 2006/0084262 | A1 | 4/2006 | Qin |

OTHER PUBLICATIONS

H. Asai et al., "Discharge Characteristics of a New Structgure AC-PDP Using Thick Film Ceramic Sheet Technology", SID 05 Digest, pp. 210-213.

* cited by examiner

ADDRESSABLE MICROPLASMA DEVICES AND ARRAYS WITH BURIED ELECTRODES IN CERAMIC

STATEMENT OF GOVERNMENT INTEREST

This invention was made with government assistance provided by the AFOSR, pursuant to contract number F49620-03-1-0391. The government has certain rights in this application.

FIELD OF THE INVENTION

The present invention relates to microcavity plasma devices, also known as microdischarge or microplasma devices, that are robust and individually addressable.

BACKGROUND

Microcavity plasmas, plasmas confined to a cavity with a characteristic spatial dimension <1 mm, have several distinct advantages over conventional, macroscopic discharges. For example, the small physical dimensions of microcavity plasma devices allow them to operate at gas or vapor pressures much higher than those accessible to a macroscopic discharge such as that produced in a fluorescent lamp. When the diameter of the microcavity of a cylindrical microplasma device is, for example, on the order of 200-300 μm or less, the device is capable of operating at pressures as high as atmospheric pressure and beyond. In contrast, standard fluorescent lamps operate at pressures typically less than 1% of atmospheric pressure. Also, microplasma devices may be operated with different discharge media (gases, vapors or combinations thereof) to yield emitted light in the visible, ultraviolet, and infrared portions of the spectrum. Another unique feature of microplasma devices, the large power deposition into the plasma (typically tens of $kW/cm^3$ or more), is partially responsible for the efficient production of atoms and molecules that are well-known optical emitters. Consequently, because of the properties of microplasma devices, including the high pressure operation mentioned above and their electron and gas temperatures, microplasmas are efficient sources of optical radiation.

Microcavity plasma devices have been developed over the past decade for a wide variety of applications. An exemplary application for an array of microplasmas is in the area of displays. Since single cylindrical microplasma devices, for example, with a characteristic dimension (d) as small as 10 μm have been demonstrated, devices or groups of devices offer a spatial resolution that is desirable for a pixel in a display. In addition, the efficiency for generating, with a microcavity plasma device, the ultraviolet light at the heart of the plasma display panel (PDP) significantly exceeds that of the discharge structure currently used in plasma televisions.

Early microplasma devices were driven by direct current (DC) voltages and exhibited short lifetimes for several reasons, including sputtering damage to the metal electrodes. Improvements in device design and fabrication have extended lifetimes significantly, but minimizing the cost of materials and the manufacture of large arrays continue to be key considerations. Also, more recently-developed microplasma devices excited by a time-varying voltage are preferable when lifetime is of primary concern.

Research by the present inventors and colleagues at the University of Illinois has pioneered and advanced the state of microcavity plasma devices. This work has resulted in practical devices with one or more important features and structures. Most of these devices are able to operate continuously with power loadings of tens of $kW\text{-}cm^{-3}$ to beyond 100 $kW\text{-}cm^{-3}$. One such device that has been realized is a multi-segment linear array of microplasmas designed for pumping optical amplifiers and lasers. Also, the ability to interface a gas (or vapor) phase plasma with the electron-hole plasma in a semiconductor has been demonstrated. Fabrication processes developed largely by the semiconductor and microelectromechanical systems (MEMs) communities have been adopted for fabricating many of these microcavity plasma devices.

This research by present inventors and colleagues at the University of Illinois has resulted in exemplary practical devices. For example, semiconductor fabrication processes have been adopted to demonstrate densely packed arrays of microplasma devices exhibiting uniform emission characteristics. Arrays fabricated in silicon comprise as many as 250,000 microplasma devices in an active area of 25 $cm^2$, each device in the array having an emitting aperture of typically 50 μm×50 μm. It has been demonstrated that such arrays can be used to excite phosphors in a manner analogous to plasma display panels, but with values of the luminous efficacy that are not presently achievable with conventional plasma display panels. Another important device is a microcavity plasma photodetector that exhibits high sensitivity. Phase locking of microplasmas dispersed in an array has also been demonstrated.

The following U.S. patents and patent applications describe microcavity plasma devices resulting from these research efforts. Published Applications: 20050148270-Microdischarge devices and arrays; 20040160162-Microdischarge devices and arrays; 20040100194-Microdischarge photodetectors; 20030132693-Microdischarge devices and arrays having tapered microcavities; U.S. Pat. Nos. 6,867,548-Microdischarge devices and arrays; 6,828,730-Microdischarge photodetectors; 6,815,891-Method and apparatus for exciting a microdischarge; 6,695,664-Microdischarge devices and arrays; 6,563,257-Multilayer ceramic microdischarge device; 6,541,915-High pressure arc lamp assisted start up device and method; 6,194,833-Microdischarge lamp and array; 6,139,384-Microdischarge lamp formation process; and 6,016,027-Microdischarge lamp.

U.S. Pat. No. 6,541,915 discloses arrays of microcavity plasma devices in which the individual devices are mounted in an assembly that is machined from materials including ceramics. Metallic electrodes are exposed to the plasma medium which is generated within a microcavity and between the electrodes. U.S. Pat. No. 6,194,833 also discloses arrays of microcavity plasma devices, including arrays for which the substrate is ceramic and a silicon or metal film is formed on it. Electrodes formed at the tops and bottoms of cavities, as well as the silicon, ceramic (or glass) microcavities themselves, contact the plasma medium. U.S. Published Patent Application 2003/0230983 discloses microcavity plasmas produced in low temperature ceramic structures. The stacked ceramic layers are arranged and micromachined so as to form cavities and intervening conductor layers excite the plasma medium. U.S. Published Patent Application 2002/0036461 discloses hollow cathode discharge devices in which electrodes contact the plasma/discharge medium.

The development of microcavity plasma devices continues, with an emphasis on the display market. The ultimate utility of microcavity plasma devices in displays will hinge on several critical factors, including efficacy (discussed earlier), lifetime and addressability. Addressability, in particular, is vital in most display applications. For example, for a group of microcavity discharges to comprise a pixel, each microplasma device must be individually addressable.

Current flat panel display solutions suffer from a number of drawbacks. Flat panel display technologies that have been widely adopted include liquid crystal displays (LCDs) and plasma display panels. These technologies have been widely adopted for large screen formats such as televisions. LCDs are also used in computer displays. Compact electronic devices also have a need for high contrast, bright, high resolution displays. For example, personal digital systems (PDA) and cellular handsets benefit from high contrast, high resolution, and bright displays.

Efficiency is a concern, particularly in applications that utilize portable power sources such as battery powered handheld devices. Since the operational lifetime of a battery-powered display is inversely proportional to power consumption, improvements in the efficiency of the display impact directly the lifetime of the power source. However, efficiency is also an issue with large, non-portable displays. Conventional plasma display panels, for example, normally operate at a low efficiency, typically converting about 1% of the electrical power delivered to the pixel into visible light. Improvement in this efficiency is a priority with the display industry, but increasing the efficiency of a conventional plasma display may require a rise in the already significant sustaining voltage necessary for operation. Current research is focused upon increasing the xenon content in the plasma display panel gas mixture, which will likely require an accompanying rise in the sustaining voltage and have an adverse impact on the cost of the driving electronics for the display. Plasma display panels and liquid crystal display panels also tend to be heavy from their use of glass to seal the displays, and can be somewhat fragile.

Practical designs that would permit the use of microcavity plasma devices would likely alter the landscape of the flat panel display industry. Compared to standard flat panel display technologies, microplasma devices offer the potential of smaller pixel sizes, for example. Small pixel sizes correlate directly with higher spatial resolution. In addition, tests have shown that microplasma devices convert electrical energy to visible light at a higher efficiency than that available with conventional pixel structures in plasma display panels.

SUMMARY OF THE INVENTION

A preferred embodiment of the invention is a microcavity plasma array formed in a ceramic substrate that provides structure for an array of microcavities defined in the ceramic substrate. The ceramic substrate also electrically isolates the microcavities from electrodes buried within the ceramic substrate and physically isolates the microcavities from each other. The electrodes are buried within the ceramic substrate and disposed to ignite a discharge in microcavities in the array of microcavities upon application of a time-varying potential between the electrodes. Embodiments of the invention include electrode microcavity arrangements that permit addressing of individual microcavities or groups of microcavities. In preferred embodiments, address electrodes straddle or surround the microcavities. In other preferred embodiments, columns of microcavities are formed between pairs of substantially coplanar, parallel electrodes that are buried in the ceramic.

DETAILED DESCRIPTION OF THE PREFERRED EMBODIMENTS

A preferred embodiment of an array of microcavity plasma devices of the invention is formed in a ceramic substrate that provides structure for microcavities that are defined in the ceramic. The ceramic substrate also electrically isolates the microcavities from electrodes buried within the ceramic substrate. Another function provided by the ceramic is that the profile of the microcavity wall, combined with the dielectric constant of the ceramic and the gas pressure in the microcavity, provides some control over the shape of the electric field in the microcavity and, hence, the spatial dependence of emission produced within the microcavity. The electrodes are disposed to ignite a discharge in microcavities in the array of microcavities upon application of a time-varying potential between the electrodes. Embodiments of the invention include electrode microcavity arrangements that permit addressing of individual microcavities or groups of microcavities.

Another preferred embodiment microcavity plasma device array of the invention includes a ceramic substrate having an array of microcavities disposed in the ceramic substrate. A first electrode is buried within the ceramic substrate and disposed proximate to a plurality of microcavities in the array. A second electrode is proximate to at least one of the microcavities to which the first electrode is proximate, and is also buried within the ceramic substrate, thereby electrically insulating the electrode from both the microcavity and the other electrode. The first and second electrodes are arranged to ignite a discharge in at least one microcavity upon application of a time-varying potential between the first electrode and the second electrode.

In preferred embodiments, the electrodes lie in the same or substantially the same plane and are parallel to one another. Devices of the invention are preferably made using low-temperature co-fired ceramic (LTCC), a material available in thin sheets which can be stacked to realize the desired structure. The ceramic packaging of preferred embodiment devices is readily integrated with electronic devices such as capacitors, resistors, and active devices.

Preferred embodiments will now be discussed with respect to the drawings. The drawings include schematic figures, which will be fully understood by skilled artisans with reference to the accompanying description. Features may be exaggerated for purposes of illustration. From the preferred embodiments, artisans will recognize broader aspects of the invention.

Figure 1:
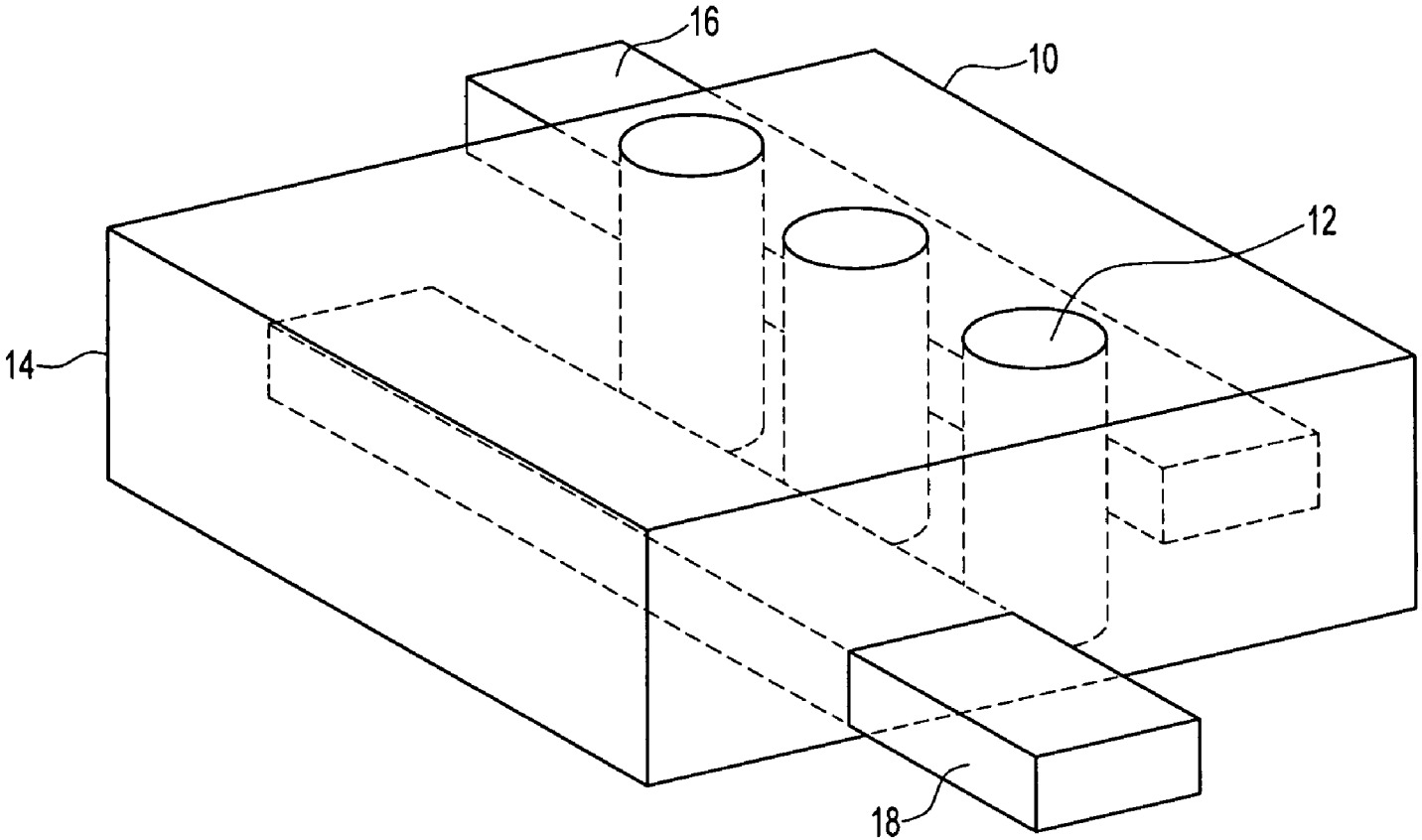
FIG. 1 is a schematic view of a preferred embodiment microdischarge array of the invention.

Referring now to the drawings, and particularly FIG. 1, which is a partially transparent schematic view of a portion of a preferred embodiment microcavity plasma device array 10, closely spaced microcavities 12 are formed in a ceramic substrate 14. Buried within the ceramic substrate is a pair of electrodes 16 and 18. The microcavities 12 can be cylindrical in cross-section, for example, with diameters at least as small as 20 μm but typically 500 μm or less. It is within each microcavity that a plasma (discharge) will be formed. The electrodes 16, 18 are spaced apart a distance from the microcavities 12, thereby isolating the electrodes 16, 18 from the discharge medium (plasma) contained in the microcavities 12. This arrangement permits the application of a time-varying (AC, RF, bipolar or pulsed DC, etc.) potential between the electrodes 16, 18 to excite the gaseous or vapor medium to create a microplasma in each microcavity.

The ceramic material 14 is preferably a low-temperature co-fired ceramic (LTCC), which provides protection of the electrodes 16, 18 from the microplasma. This avoids sputtering of the electrodes, which limits the lifetime of the device. An advantage of this design is that the technology for processing LTCC is advanced. The FIG. 1 structure may be replicated to yield a high density of microcavities 12 in large arrays. While the microcavities 12 are shown as being cylindrical, other cross-sections such as rectangular trenches are also acceptable. Structures constructed from low-temperature co-fired ceramics may be built up from thin layers, one layer at a time, and the entire process may be automated. These processes, including screen printing of the electrodes, are widely used in the automotive electronics, and cell phone industries, for example. The exemplary embodiment microcavity plasma device array 10 of FIG. 1 can produce a display in which columns of microcavities 12 are excited simultaneously in a robust, monolithic structure.

Figure 2:
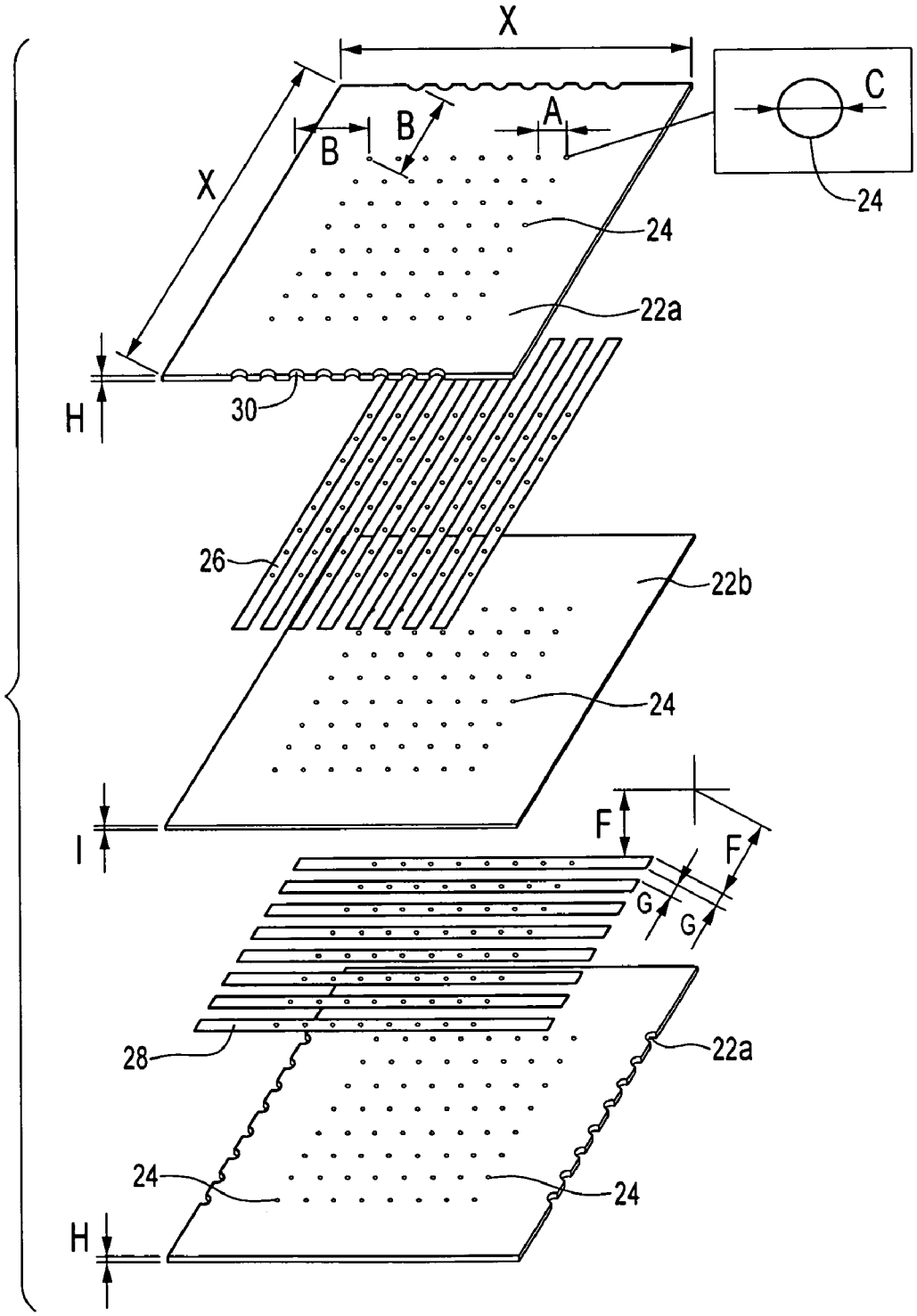
FIG. 2 shows an exploded perspective schematic view of a preferred embodiment array of microcavity plasma devices of the invention.

Alternatively, addressing a single microcavity can be accomplished. FIG. 2 illustrates a preferred embodiment microcavity plasma array that offers addressability of individual microcavities, which may constitute pixels, for example. Individual addressability is important in a variety of applications, and particularly in display applications and several biomedical diagnostics. The device is illustrated in FIG. 2 as being formed from multiple layers 22*a*, 22*b* of LTCC material. The layers 22*a* are essentially identical and define with the layer 22*b* a plurality of aligned microcavities 24. The layer 22*b* is thin and serves to provide a base for the formation of first electrodes 26 and second electrodes 28, which run transversely in parallel planes.

The first electrodes 26 are generally parallel to each other and are coplanar or substantially coplanar, as are the second electrodes 28. In the illustrated embodiment, a column of microcavities 24 is disposed between each adjacent pair of first electrodes 26. Although a column of microcavities 24 can be situated between every adjacent pair of first electrodes 26, this is not necessary. Each microcavity is also bounded by an adjacent pair of second electrodes 28. That is, if one looks along the axis of any microcavity 24, the microcavity will be seen to lie between an adjacent pair of first electrodes 26 and an adjacent pair of second electrodes 28. The axis of the microcavity is nominally perpendicular to planes defined by the first electrodes 26 and the second electrodes 28.

Together, the first electrodes form a first electrode array. Together, the second electrodes 28 form a second electrode array. In one embodiment, each microcavity will intersect the planes defined by the first electrode array and the second electrode array. In another embodiment, this intersection is not necessary. Individual microcavities in the array are addressed by applying a time-varying voltage of the proper magnitude to a specific pair of adjacent first electrodes 26 and to a specific pair of adjacent second electrodes 28. One pair of electrodes serves as the address electrodes and one pair as the sustain electrodes. The magnitude of the voltage applied to each pair will normally not be equal and depends on the gas in the microcavity, its pressure, and the dimensions of the microcavity and electrode arrays.

Artisans will also appreciate that groups of microcavities could also be addressed. Group excitation can be realized by the excitation of more than one adjacent electrode simultaneously, as will be appreciated by artisans. Many other addressing schemes will be apparent to artisans, as well, as the example embodiments of the invention enable a wide variety of addressing schemes.

Openings 30 are located at opposing ends of ceramic sheets 22*a* to accommodate electrical connections to the electrodes in electrode array 26 and electrode array 28. Notice that, because the first electrodes 26 are perpendicular to the second electrodes 28, the openings 30 on the upper layer 22*a* are at different ends of layer 22*a* than are the openings 30 on the lower layer (or sheet) 22*a*. Arrays of first electrodes 26 and second electrodes 28 can be fabricated by a variety of processes. One low cost method is screen printing from a Pt or Ag paste but other conducting materials are also acceptable. Similarly, electrical connections to arrays of first electrodes 26 and second electrodes 28 can be fabricated by a number of well-known methods, including the use of metal pastes.

To fabricate the device of FIG. 2, sheets 22*a* and 22*b* are cut to size, the hole patterns (microcavities 24 and openings 30) are produced in sheets 22*a* and 22*b*, and the electrode arrays 26 and 28 are formed on ceramic sheet 22*b*. After sheets 22*a* and 22*b* are aligned, they are pressed together while being heated. This process produces a monolithic ceramic structure in which the first electrodes 26 and second electrodes 28 are buried in ceramic and a pair of adjacent electrodes straddles each column of microcavities 24. Advantages of fabricating arrays in LTCC include the availability of automated processing and the stability of this material at high temperature and in the presence of chemically aggressive environments.

Microcavity plasma arrays of the invention can be fabricated, with such a process, in a wide variety of sizes, geometric arrangements, and microcavity addressing schemes, as artisans will appreciate. For exemplary purposes only, an array consistent with FIG. 2 has a length and width X of approximately 50 mm. A pitch A between microcavities 24 is 4 mm. A distance B between the array of microcavities 24 and the edge of the substrate is 11 mm. A microcavity diameter C is 0.115 mm (115 μm). A distance F between the edge of the electrodes and of the substrate is 10 mm. A width and spacing G between electrodes is 2 mm. The thickness of layers 22*a* is 0.5 mm and a thickness I of the layer 22*b* is 0.2 mm. A thickness of the electrodes 26 and 28 is approximately 0.2 mm. Exemplary electrodes are gold or silver electrodes. The total thickness of the device after fabrication is, for example, approximately 1.2 to 1.5 mm. Again, the dimensions are for an example embodiment only. Artisans will recognize that larger and smaller arrays may be made and the microcavity diameter and pitch varied over a wide range. Artisans will also recognize that large scale arrays may be formed from a replication of small arrays.

Figure 3B:
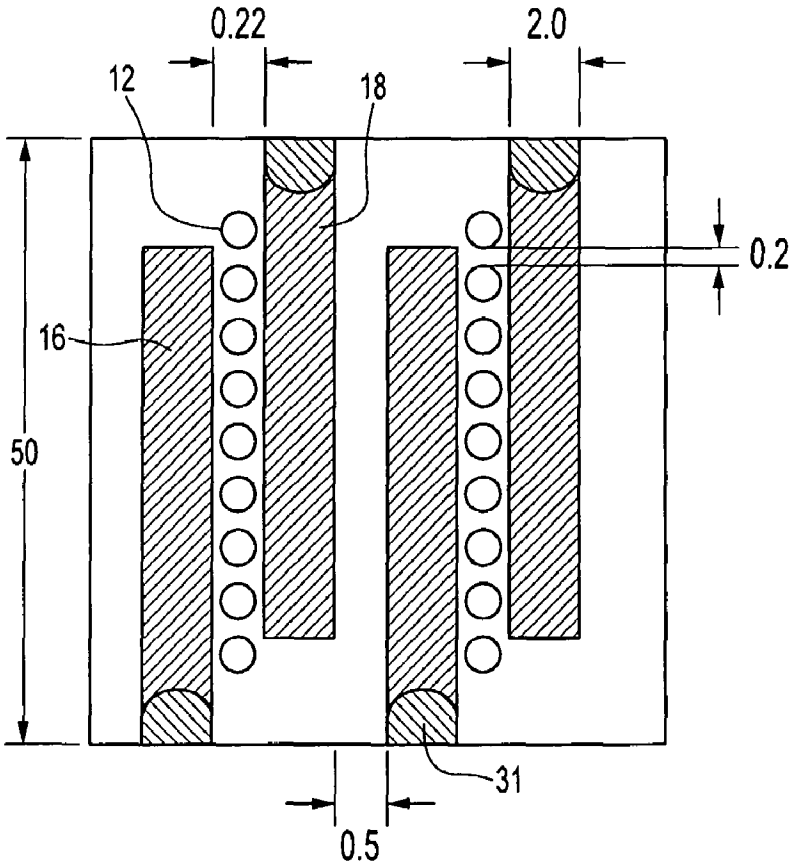
FIGS. 3A and 3B are, respectively, a side (end-on) and top view cross-sectional diagrams of two linear arrays of microcavity plasma devices fabricated in ceramic.
Figure 3A:
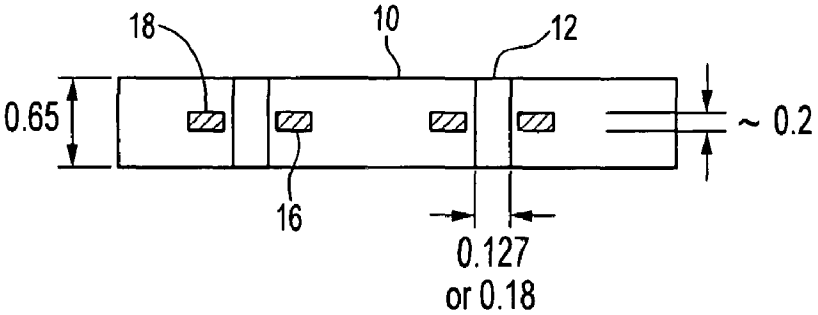

As a further example, FIG. 3 provides details of an array of microplasma devices that has been fabricated and tested. The dimensions are strictly exemplary and are indicated to provide the details of the arrays that were fabricated and tested. The example array shown in FIGS. 3A and 3B is consistent with the FIG. 1 embodiment. The reference numbers used in FIG. 1 identify analogous features of the exemplary embodiment of FIGS. 3A and 3B. In the arrays that were fabricated, the microcavities 12 were cylindrical with diameters of either 127 μm or 180 μm, as indicated. The buried electrodes 16, 18 were substantially coplanar and the separation between the inner edges of the electrodes was 200 μm. The electrodes 16, 18 in the experimental devices terminated in exposed contacts 31.

Figure 4:
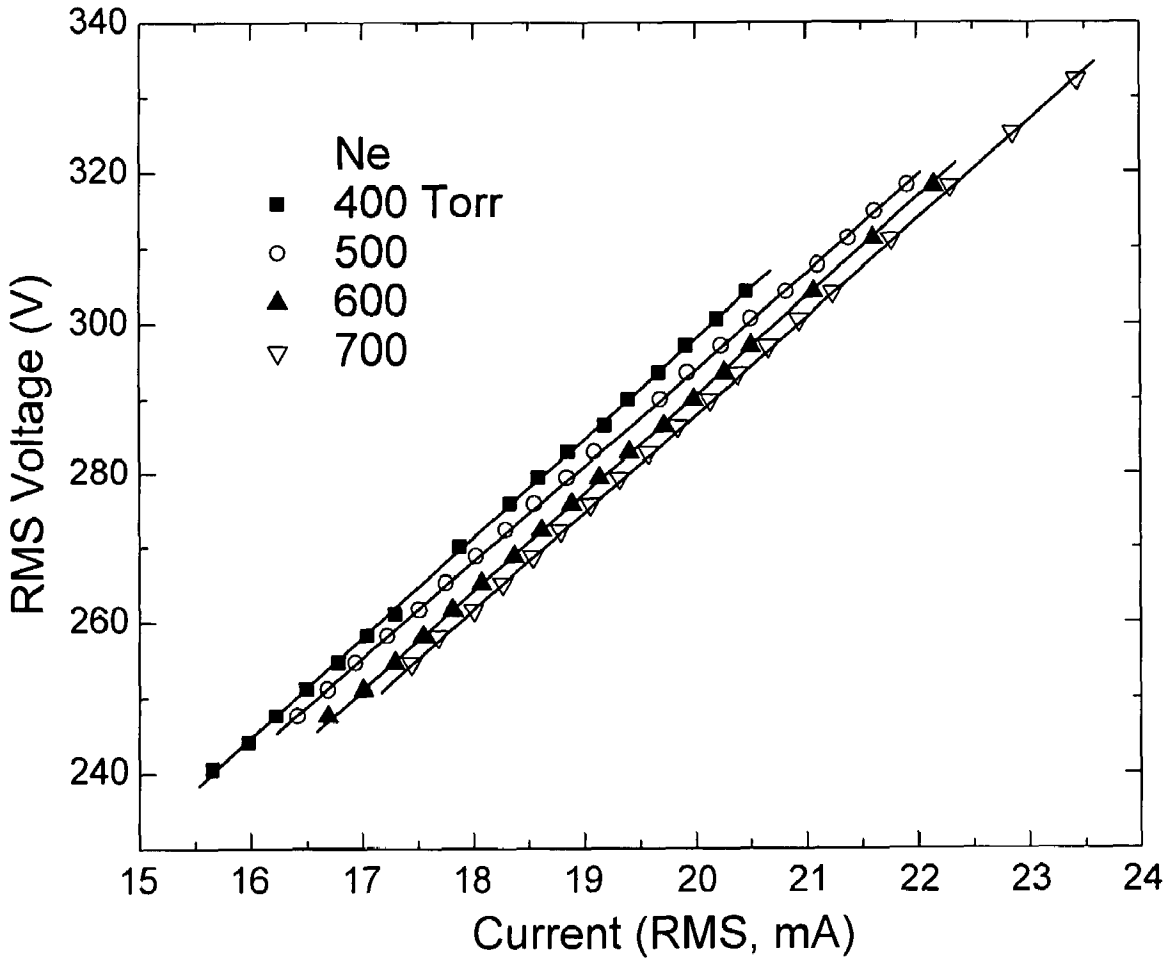
FIG. 4 shows exemplary V-I characteristics for an array of experimental microplasma devices having the structure of FIGS. 3A and 3B.
Figure 5A:
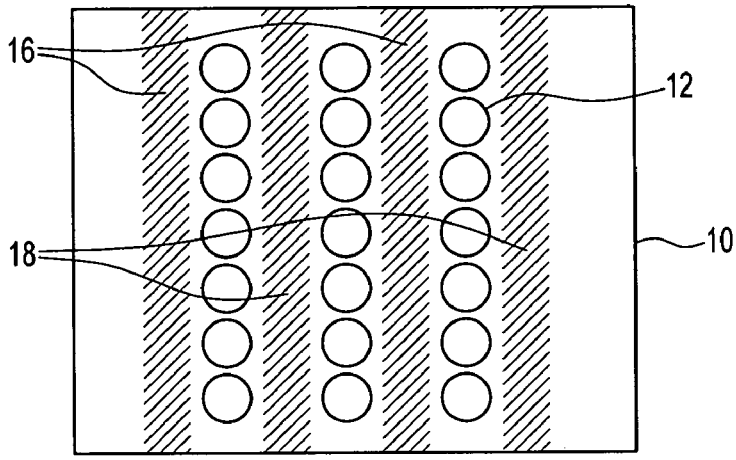
FIG. 5A is a top view and FIGS. 5B and 5C are side view cross-sectional diagrams of additional embodiment microcavity plasma device arrays of the invention.
Figure 5B:
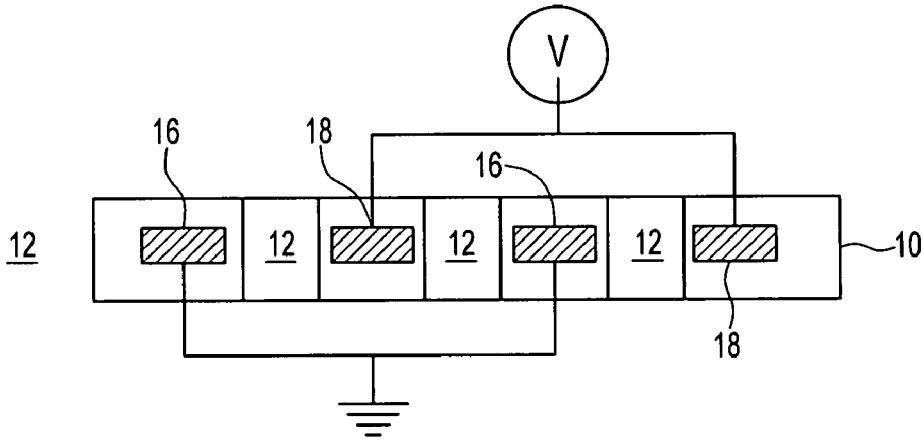
Figure 5C:
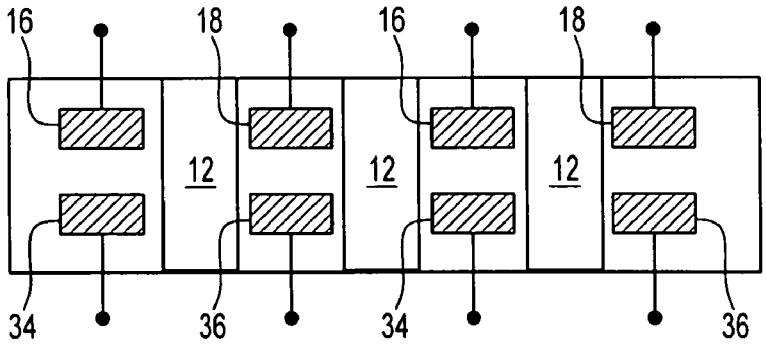

Experiments have been conducted to verify operational characteristics of arrays of the invention. FIG. 4 shows V-I characteristics for arrays having the structure shown in FIGS. 3A and 3B. The exemplary device was an array consisting of a single column of 72 microcavities. Each microcavity had a diameter of 127 μm. The data shown in FIG. 4 were obtained for neon gas at pressures from 400 Torr to 700 Torr when the array was excited with a bipolar (pulsed DC) waveform having a frequency of 20 kHz. The electrical characteristics measured and shown in FIG. 4 have a positive slope, demonstrating that the discharges operate in the abnormal glow mode. It is, therefore, not necessary to supply external ballast for the array.

Another advantage of this invention is that the electric field within the microcavity can be shaped. Specifically, the contour of the ceramic at the microcavity wall, in combination with the gas pressure and the identity of the gas (or vapor) itself, determine to a limited extent the spatial variation of the electric field strength in the microcavity.

Prototype devices having the structure of FIGS. 3A and 3B have been constructed and operated. Specifically, two sets of arrays were fabricated. The microcavities in both arrays were cylindrical with diameters of 127 μm or 180 μm. Images of the microplasmas generated in the microcavities were recorded with a CCD camera and an optical telescope. It is apparent from these images (microphotographs) that the emission (and associated electric field within the microcavity) is concentrated into an angular region determined by several factors, one of which is the radius of curvature of the microcavity wall. Stated another way, the electric field can be concentrated, or "focused," because of the curvature of the ceramic/plasma interface. Embodiments of the invention provide a property that differs considerably from previous microcavity plasma devices in which excitation electrode pairs lie in two different planes or have a vertical separation therebetween and the intent generally has been to produce a microplasma that is azimuthally uniform. Applications of this property of the present invention are extensive, including the generation of particular atomic or molecular species that require large electric field strengths to be produced. Embodiments of the invention have substantially coplanar electrode pairs or electrode pairs that are vertically aligned with respect to the axis of the microcavity. This permits the concentration of the electric field. Also, the profile of the ceramic/plasma interface can be modified from the circular shape of FIGS. 1, 2, 3A and 3B. Altering the shape of the ceramic/plasma interface allows for other emission patterns to be produced.

Additional embodiments of the invention are shown schematically in FIGS. 5-9. In FIGS. 5-9, like reference numbers from FIGS. 1-3B will be used to indicate similar parts. FIG. 5A is a schematic diagram of a top view, applicable to FIGS. 5B and 5C, of the embodiment. The structure shown in FIG. 5A includes substantially coplanar electrodes as in FIGS. 1, 3A and 3B. FIG. 5B presents an approach for applying power to the electrodes 16, 18. Specifically, every other electrode can be grounded. FIG. 5C illustrates an alternative embodiment in which two sets of substantially coplanar electrodes 16, 18 and 34, 36 are provided between each microcavity 12 in a linear array. The first electrodes, e.g., 16 and 34, can serve to sustain the microcavities 12, whereas the second electrodes e.g., 18 and 36 can be used to address specific microcavities 12.

Figure 6:
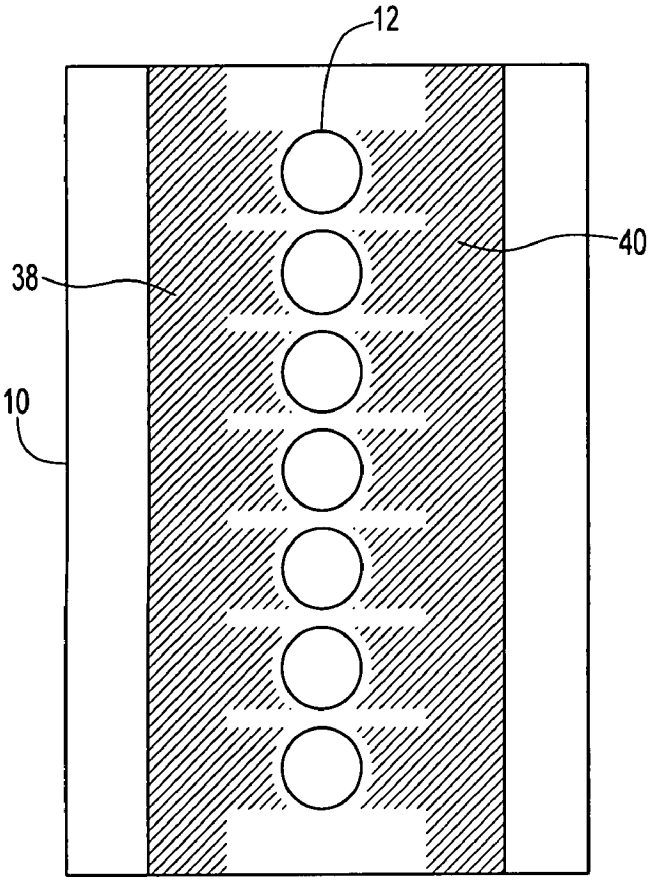

Another embodiment of the invention is shown in FIG. 6. A single column of microcavities 12 is shown and, if desired, the column can be replicated as in FIGS. 1-5. In FIG. 6, first and second electrodes 38, 40 are shaped so that the thickness of the ceramic between each of the electrodes and the nearest edge of a microcavity is constant. In a preferred embodiment consistent with FIG. 6, the first and second electrodes 38, 40 are substantially coplanar.

Figure 8:
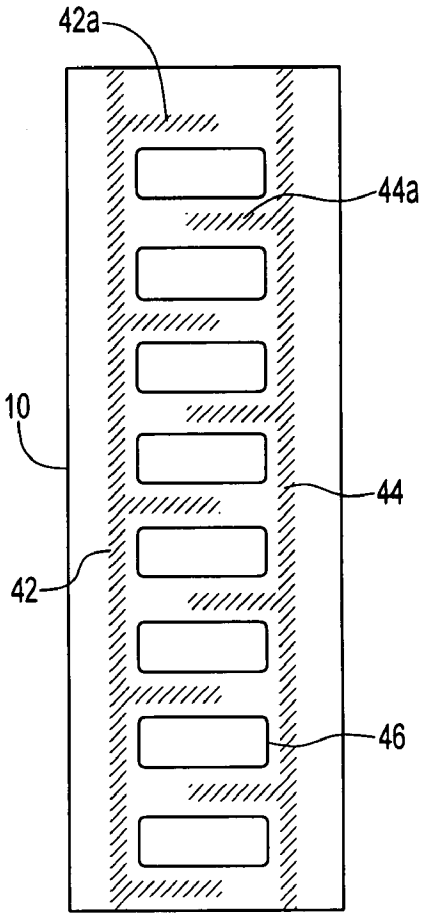
FIGS. 6-11B also show top and/or side view cross-sectional diagrams of additional embodiment microcavity plasma device arrays of the invention.
Figure 7:
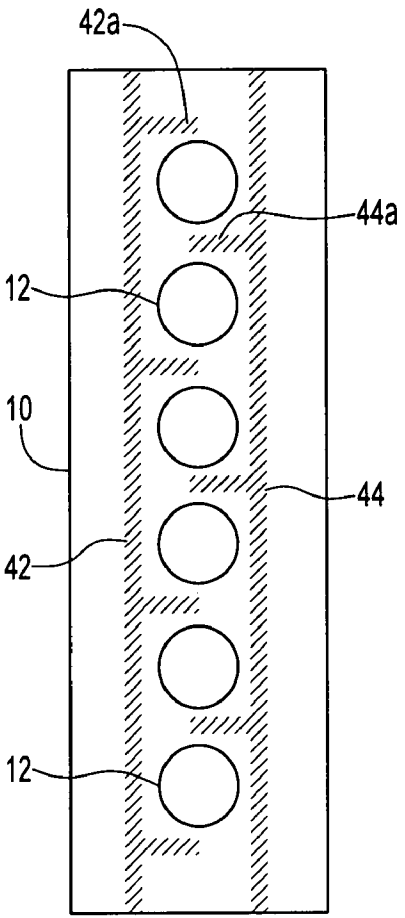
Figure 9:
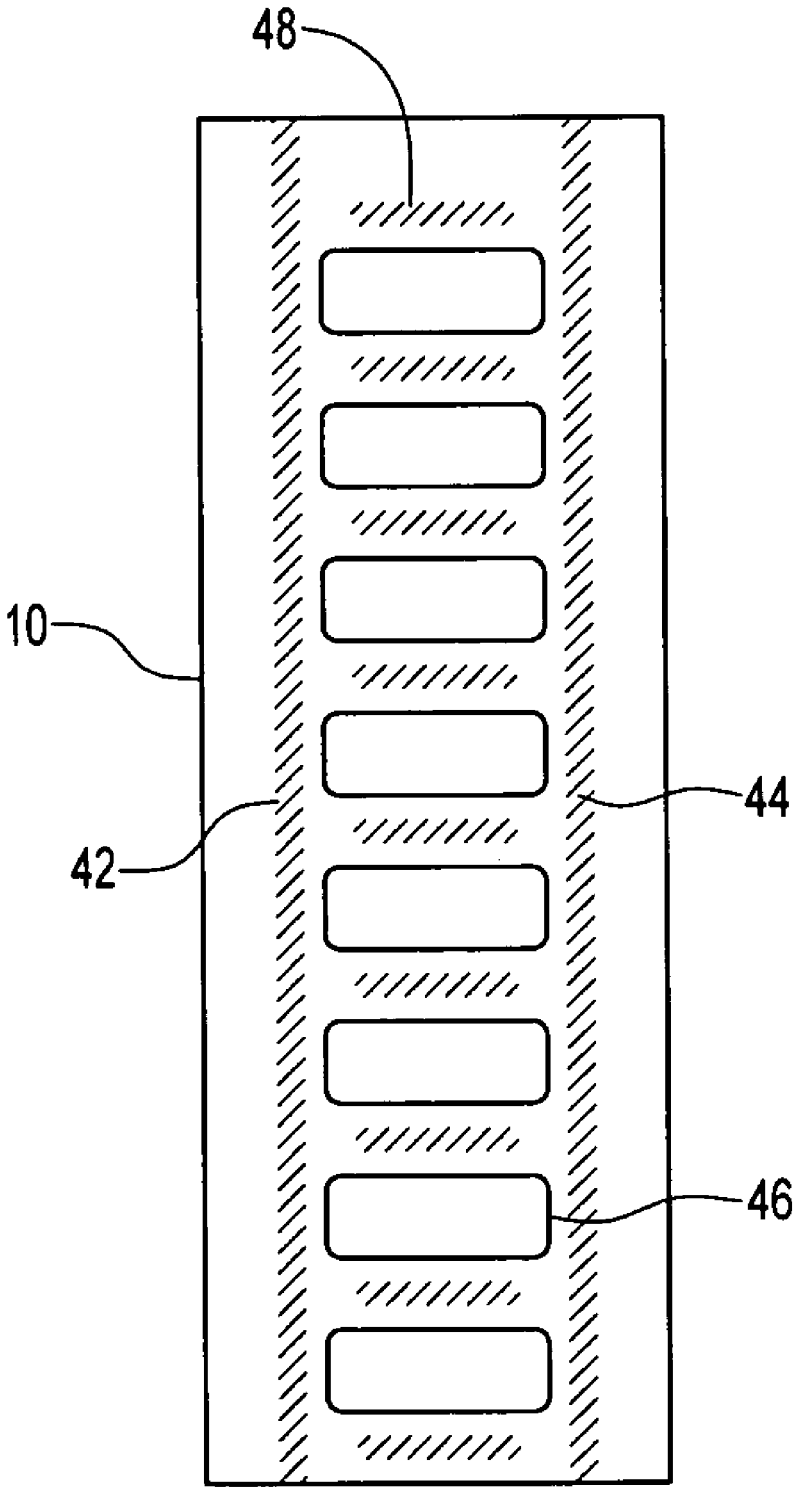

Another embodiment of the invention is illustrated by the top view of a linear array of microcavity plasma devices shown in FIG. 7. In this embodiment, the main electrodes are again substantially coplanar but first and second electrodes 42, 44 include segments 42*a*, 44*a* that extend between microcavities 12 in the column. These electrode segments 42*a*, 44*a* are effective in reducing the ignition voltage for the array. Another embodiment in FIG. 8 is similar to the FIG. 7 embodiment, but includes microcavities 46 having a substantially rectangular cross-section. FIG. 9 shows another embodiment similar to the embodiments of FIGS. 7 and 8, except that a third set of electrodes 48 replace the electrode segments 42*a* and 42*b*. The third electrodes 48 are not electrically connected to either of the first or second substantially coplanar electrodes 42, 44. These ignition 48 electrodes can be buried in the ceramic and electrically isolated from electrodes 42 and 44 and driven by a separate voltage source.

Figure 10A:
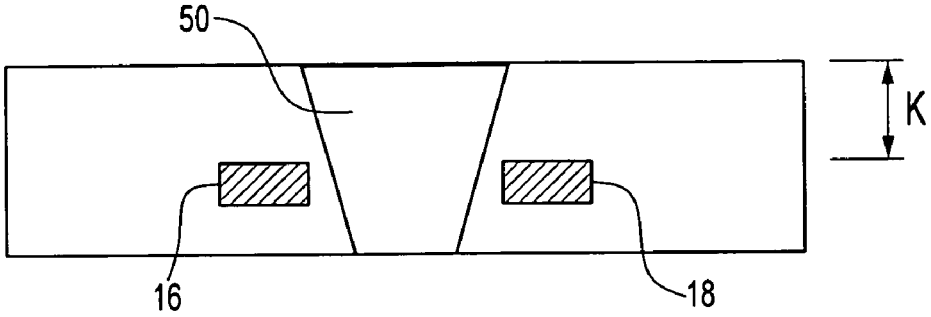
Figure 10B:
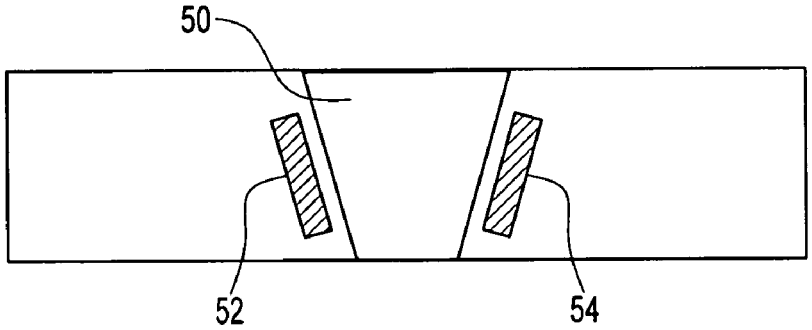
Figure 10C:
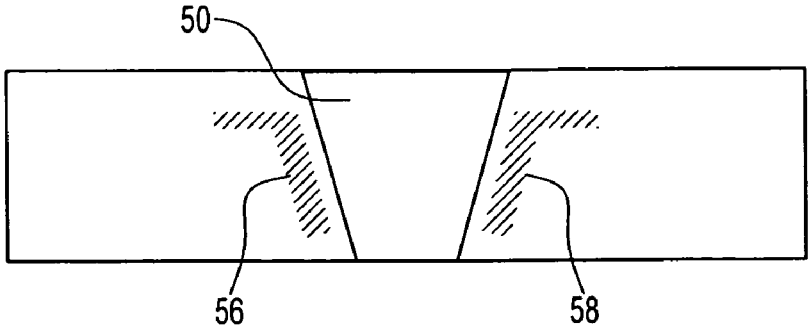

Microcavities in embodiments of the invention can also have a cross section that varies as a function of depth in the ceramic. FIGS. 10A, 10B and 10C show embodiments of the invention including tapered microcavities 50 having a truncated conical shape. In the embodiment of FIG. 10A, first and second buried electrodes 16, 18 are substantially coplanar as, for example, in the FIG. 1 embodiment. With the variable cross section, the characteristics of the discharge are strongly dependent upon the location of the electrodes. The value of K determines the thickness of the ceramic between the inside edge of each electrode and the microcavity wall. Nominal values of the ceramic thickness are between 1 μm and 500 μm. In the embodiment of FIG. 10B, first and second electrodes 52, 54 are oriented parallel to the microcavity wall. Such an electrode/microcavity geometry can be fabricated in several ways, one of which is to deposit metal on the inside of a conical cavity, and subsequently overcoat the metal with a thin ceramic layer. FIG. 10C shows an embodiment of the invention in which the buried electrodes 56, 58 have at least two sections, one of which lies parallel to the microcavity 50.

Figure 11B:
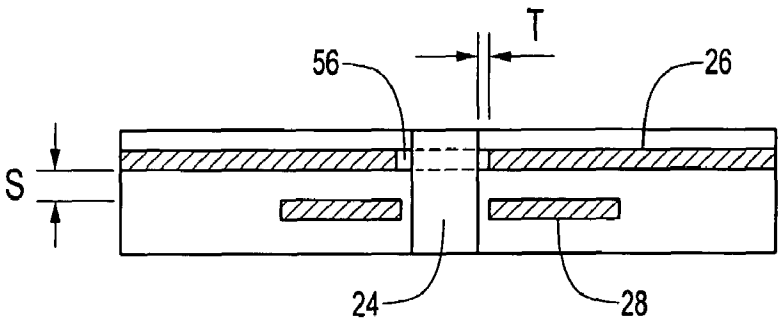
Figure 11A:
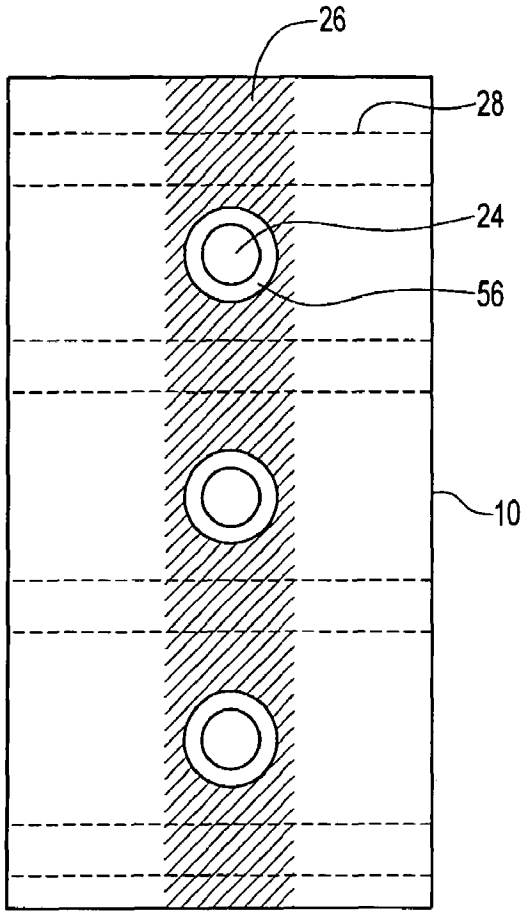

Another embodiment of the invention in which the microplasma devices are individually addressable, in a manner similar to the FIG. 2 embodiment shown in FIGS. 11A and 11B. In the embodiment of FIGS. 11A and 11B, address electrodes 26 surround the microcavities 24). A thin ceramic ring 56 isolates the address electrode from the edge of the microcavities 24. The ring 56 separates the electrode 26 from the microcavities by a distance T. Sustain electrodes 28 are substantially coplanar and disposed between microcavities 24 at a distance S from the electrode 26. Both the address electrode and sustain electrodes are buried in the ceramic 10 and, if desired, the structure of FIG. 11 can be driven by the same method and electronics used in current PDPs.

Artisans will recognize many applications for microcavity plasma arrays of the invention. The low power demands and high efficiencies of the microplasmas make arrays particularly suitable for display applications. Single discharges or groups of discharges may be combined to form pixels in a display. The discharges may excite phosphors to produce color displays. Biomedical diagnostics, such as the photoexcitation of a dye-labeled biomolecule, is another application ideally suited for these arrays. The ceramic arrays also provide the opportunity to integrate microcavity plasma arrays of the invention with electronic components (capacitors, resistors, inductors, etc.).

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

The invention claimed is:

1. A microcavity plasma device, comprising:

a ceramic substrate;

an array of microcavities disposed in said ceramic substrate;

a first electrode buried in said ceramic substrate, said first electrode disposed proximate to a plurality of microcavities in said array of microcavities, said first electrode being isolated from said plurality of microcavities by said ceramic substrate; and a second electrode buried in said ceramic substrate, said second electrode disposed proximate to at least one of said plurality of microcavities, said second electrode being electrically isolated from said at least one of said plurality of microcavities by said ceramic substrate, said second electrode being disposed to cooperate with said first electrode to ignite a discharge in said at least one of said plurality of microcavities upon application of a time-varying potential between said first electrode and said second electrode.

2. The device of claim 1, wherein said first electrode and said second electrode are substantially coplanar, parallel and disposed upon opposite sides of said plurality of microcavities.

3. The device of claim 2, wherein at least one of said first electrode and said second electrode includes electrode segments extending between adjacent microcavities in a column of microcavities in said plurality of microcavities.

4. The device of claim 2, further comprising a third electrode disposed between adjacent microcavities in a column of microcavities in said plurality of microcavities.

5. The device of claim 2, wherein each of said plurality of microcavities has a cross-section that varies with the depth of said ceramic substrate.

6. The device of claim 1, wherein each of said plurality of microcavities has a cross-section that varies with the depth of said ceramic substrate, and said first electrode and said second electrode are disposed parallel to walls of said plurality of microcavities.

7. The device of claim 1, wherein each of said plurality of microcavities comprises a truncated conical microcavity.

8. The device of claim 1, wherein said first electrode and said second electrode are each shaped so that a thickness of the ceramic substrate between each of said first and second electrodes and an edge of a nearest one of said plurality of microcavities is constant.

9. The device of claim 1, wherein said first electrode and said second electrode are disposed in parallel planes.

10. The device of claim 9, wherein said first electrode and said second electrode are transverse with respect to each other.

11. The device of claim 10, wherein one of said first electrodes and said second electrodes surrounds said plurality of microcavities and is separate from the edge of each of said plurality of microcavities by a thin ring portion of said ceramic substrate.

12. The device of claim 10, wherein:

said array of microcavities comprises columns of microcavities;

said first electrode comprises a plurality of address electrodes disposed proximate to columns in said plurality of microcavities; and said second electrode comprises a plurality of sustain electrodes disposed proximate to said columns of microcavities.

13. The device of claim 12, wherein:

said plurality of first electrodes terminate in first electrode contacts, said ceramic substrate defining a first connector to said first electrode contacts; and said plurality of second electrodes terminate in second electrode contacts, said ceramic substrate defining a second connector to said second electrode contacts.

14. The device of claim 12, wherein:

each of said plurality of first electrodes includes first holes having diameters larger than respective microcavities in said rows of microcavities and said microcavities in said rows of microcavities pass through respective ones of said first holes;

each of said plurality of second electrodes includes second holes having diameters larger than respective microcavities in said columns of microcavities and said microcavities in said columns of microcavities pass through respective ones of said second holes.

15. A microcavity plasma array device, comprising:

a ceramic substrate;

an array of microcavities disposed in said ceramic substrate;

electrodes means buried within said ceramic substrate, isolated from said microcavities, but disposed to ignite a discharge in microcavities in said array of microcavities upon application of a time-varying potential between said electrodes.

16. The device of claim 15, wherein said electrode means are disposed to address individual microcavities within said array of microcavities.

17. The device of claim 15, wherein said electrode means comprises groups of sustain electrodes and groups of address electrodes.

18. The device of claim 17, wherein said electrode means further comprises means for igniting plasma in each microcavity in said array of microcavities.

* * * * *